US005673943A

United States Patent [19]

Campbell

[11] Patent Number: 5,673,943

[45] Date of Patent: Oct. 7, 1997

[54] MULTI-PURPOSE COMBINATION TAG AND LABEL SYSTEM

[76] Inventor: Christopher C. Campbell, 469 Brookhurst Ave., Narberth, Pa. 19072

[21] Appl. No.: 718,090

[22] Filed: Sep. 17, 1996

[51] Int. Cl.[6] ..... B42D 15/00

[52] U.S. Cl. ..... 283/79; 283/81; 40/299; 40/630

[58] Field of Search ..... 283/79, 80, 81, 283/101; 40/299, 630

[56] References Cited

U.S. PATENT DOCUMENTS

| | | | |
|---|---|---|---|
| Re. 30,958 | 6/1982 | White . | |
| 3,648,838 | 3/1972 | Hiromura | 283/80 X |
| 3,684,869 | 8/1972 | Reiter . | |
| 4,688,826 | 8/1987 | Hosoya | 283/79 |
| 4,726,131 | 2/1988 | Cass . | |
| 4,925,716 | 5/1990 | Haas . | |
| 5,031,939 | 7/1991 | Webendorfer et al. . | |
| 5,139,836 | 8/1992 | Burke . | |
| 5,271,642 | 12/1993 | Jahier et al. . | |
| 5,343,647 | 9/1994 | Bulka . | |
| 5,351,993 | 10/1994 | Wright et al. . | |
| 5,421,778 | 6/1995 | Kouramanis | 283/79 X |
| 5,427,640 | 6/1995 | Daniels . | |
| 5,437,477 | 8/1995 | Olivera et al. . | |
| 5,449,201 | 9/1995 | Miller et al. | 283/79 |
| 5,484,168 | 1/1996 | Chigot . | |
| 5,509,694 | 4/1996 | Laurash et al. . | |
| 5,573,277 | 11/1996 | Petkovsek | 283/79 |

*Primary Examiner*—Willmon Fridie, Jr.
*Attorney, Agent, or Firm*—Ratner & Prestia

[57] ABSTRACT

A multipurpose combination label and tag system adapted for use in shipping products stored within a tanker. The system includes a release liner, at least one unperforated tag, and at least one unperforated label. The tag has a front side and a back side. Printed matter may be deposited on the front side of the tag using an ink. An insubstantial adhesive area is disposed on the back side of the tag, bonding the tag temporarily to the release liner. A hole in the tag allows the tag to be affixed to a product tanker. The label also has a front side and a back side. Printed matter may be deposited on the front side of the label using an ink. An adhesive area is disposed on the back side of the label, bonding the label to the release liner and substantially permanently to a sample container upon application of the label to the sample container. The tag is particularly suited for use in a laser printer.

20 Claims, 4 Drawing Sheets

MULTI-PURPOSE COMBINATION TAG AND LABEL SYSTEM

FIELD OF THE INVENTION

The present invention relates generally to adhesive labels and, more particularly, to a multi-purpose tag and label system adapted for use in shipping certain products such as chemicals in bulk tankers.

BACKGROUND OF THE INVENTION

Laser printers are particularly well-suited for fast, clear printing and provide flexibility in the type and range of images that can be printed. A laser printer generates an image by fusing toner particles to the surface of a sheet material fed into the laser printer. Good and proper fusing requires the sheet material to be receptive to the toner particles.

Pressure-sensitive labels are well known and are commonly used in many applications where the display of information is desirable. Laser printers are well suited for printing pressure sensitive labels. To print a pressure sensitive adhesive label with a laser printer, the adhesive label/backing sheet set is fed through a laser printer and a desired image is printed upon the label. After removing the printed label/backing sheet set from the laser printer, the label is applied by first peeling it from the backing sheet and then applying it to a desired location.

Although paper works very well with laser printers, providing a surface which is receptive to and capable of retaining the toner image, there are situations where a label may be exposed to rough handling or adverse environmental conditions. Under such conditions, traditional paper labels are inadequate. Such conditions are common in the chemical industry where chemicals are stored and transported in large bulk containers such as rail-cars (tank cars), tractor-trailer tankers (collectively, "tankers"). These containers are often stored outdoors in areas where weather and abrasions from handling and storage can damage any label adhered to the containers.

It is common in the chemical industry to apply a card to the bulk tanker before shipping the tanker. The card may contain such identifying indicia as the name of the chemical producer, the name and address of the purchaser receiving the shipment, the lot and order number, the date of shipment, and the like. The card also may contain hazard/warning information, which is common when shipping chemicals. It is important that the card is securely attached to the tanker to ensure that the warning, product safety, and shipping information travel with the tanker. These cards are typically inserted into a plastic sleeve which, in turn, is attached to the tanker. The tag is often written by hand or typed with the desired information prior to insertion into the plastic sleeve. Such a system is labor intensive and requires an inventory of both plastic sleeves and cards. There is also the possibility of incomplete information or information that is written illegibly on the card.

It is also common in the chemical industry to test a sample of the chemical present in a particular tanker and/or forward the sample to the customer. The sample is typically "shunted" from the main flow filling the tanker into a test container, vial or the like prior to testing and/or forwarding to a customer Like the tanker, the sample container is also labeled with pertinent information such as the date, material, batch or lot number, order number, drum or package number, special instructions regarding fire and health risks and reactivity, and the test results. These labels must adhere permanently to sample container even under the adverse conditions noted above. Typically these labels are adhesively applied to the sample container.

Like the tanker cards, the labels for the sample containers are typically handwritten or typed before adhering to the sample container. When combined with the steps required to mark the tanker, these present systems amplify the potential for mistakes and inconsistencies, increase the amount of labor involved and are time consuming.

An example of another system adapted for use in the shipping industry is provided in U.S. Pat. No. 5,509,694 granted to Laurash et al. The '694 patent ostensibly describes a label system or business form that includes a plurality of individual panels and can include a removable tab referenced as item 52 in FIG. 9. The system contains perforated panels that are suitable for the placement of a forwarding address, as well as panels suitable for invoice or receipt purposes. The system comprises a label ply 12 and a liner ply 14 (FIGS. 1 and 2). The adhesive 26 used may be a removable or permanent adhesive (column 4, lines 17–18). The release coating may extend over the entire surface of the liner ply or may include only selective areas corresponding to the placement of pressure sensitive adhesive on the label ply. The label ply may be made from paper, coated paper, plastic film, or paper and plastic laminated materials.

The placement of adhesive on the label of the '694 patent prevents easy removal of the label from a container once the label is applied. This suggests that the adhesive and the label itself are of a permanent nature. In addition, because the label is applied permanently, no printed matter could be read which is placed on the back side of the label.

The system is designed so that the entire form may be printed to contain all necessary information in a single pass through a printing device. This is desirable because, in preparing labels, it is less expensive and more efficient to have a single printer (preferably a laser printer) perform the printing operation. A single printer also helps to avoid the confusion and risk of error inherent in printing different labels.

The individual panels of the label disclosed by the '694 patent are connected along perforated fold lines 22 and 24. The perforations in the panels of the '694 patent prevent one from quickly marking a container; it is often difficult to separate panels quickly along perforations. The user also risks tearing the panels when attempting to separate them along the perforations.

SUMMARY OF THE INVENTION

To achieve these and other objects, and in view of its purposes, the present invention provides a multipurpose combination tag and label system adapted for use in shipping products. The invention includes a release liner, at least one unperforated tag, and at least one unperforated label. The tag has a front side and a back side. Printed matter can be deposited on the front side and the back side of the tag using an ink. An insubstantial adhesive area is disposed on the back side of the tag, bonding the tag temporarily to the release liner. A hole in the tag allows the tag to be affixed to a product tanker. The label also has a front side and a back side. Printed matter is deposited on the front side of the label using an ink. An adhesive area is disposed on the back side of the label, bonding the label to the release liner and substantially permanently to a product tanker or sample container upon application of the label to the tanker or sample container.

It is to be understood that both the foregoing general description and the following detailed description are exemplary, but are not restrictive, of the invention.

BRIEF DESCRIPTION OF THE DRAWING

The invention is best understood from the following detailed description when read in connection with the accompanying drawings, in which.

DETAILED DESCRIPTION OF THE INVENTION

A. Combination Tag And Label System

Figure 1:
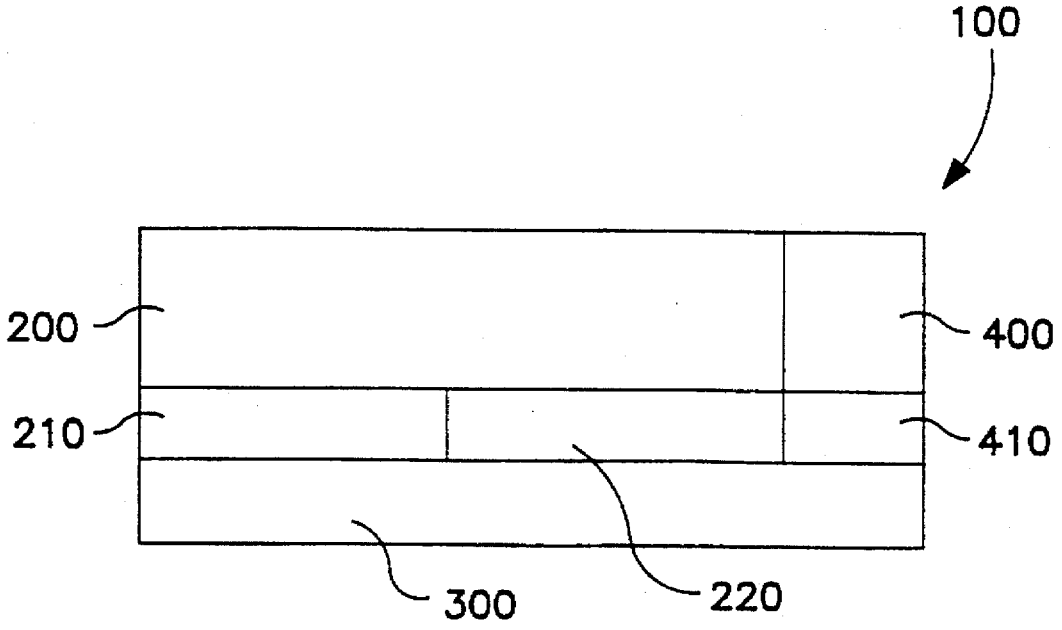
Fig. 1 is a cross sectional view of the combination tag and label system according to the present invention.

Referring now to the drawings, wherein like reference numerals refer to like elements throughout, FIG. 1 is a cross sectional view of the combination tag and label system 100. It is emphasized that, according to common practice, the various elements and layers of the drawings are not drawn to scale. On the contrary, the width or length and thickness of the various layers and elements have been arbitrarily expanded or reduced for clarity. Combination tag and label system 100 has a tag 200, a label 400, a first adhesive 210, a second adhesive 410, and a one-piece release liner 300. Open area 220 may be filled with air or, alternatively, tag 200 may lie in direct (non-adhesive) contact with release liner 300 in this area.

There are commercially available release liners designed for use with laser printers that are known by those skilled in the art. A suitable material for release liner 300 is a #50 bleach supercalendered kraft (S2S) base sheet, silicone coated on one side using an addition-cured release system. In an exemplary embodiment, release liner 300 is an 8½ inch ×11 inch sheet for ease of operation with a laser printer. Release liner 300 can cover the entire surface or selected areas of combination tag and label system 100. The combined dimensions of tag 200 and label 400 may be slightly smaller than the 8½ inch×11 inch release liner 300, for example, to assist in removal of tag 200 and label 400 from release liner 300. In general, however, tag 200 and label 400 can be sized as desired.

Tag 200 and label 400 are easily removed from release liner 300 by peeling either away from release liner 300. Release liner 300 can be flexible to eliminate stiffness. Accordingly, combination tag and label system 100 can be provided in the form of a sheet or a roll. In addition, combination tag and label system 100 is adapted for use in conjunction with a laser printer and, specifically, is adapted for a single pass through a laser printer.

Combination tag and label system 100 of the present invention provides a discrete combination tag 200 and label 400. This permits easy removal of both tag 200 and label 400, individually, because there are no perforations to hinder or slow down the removal process for either tag 200 or label 400. Because combination tag and label system 100 can be provided with an infinite variety of printed indicia, it can have multi-purposes.

B. Tag

Figure 2:
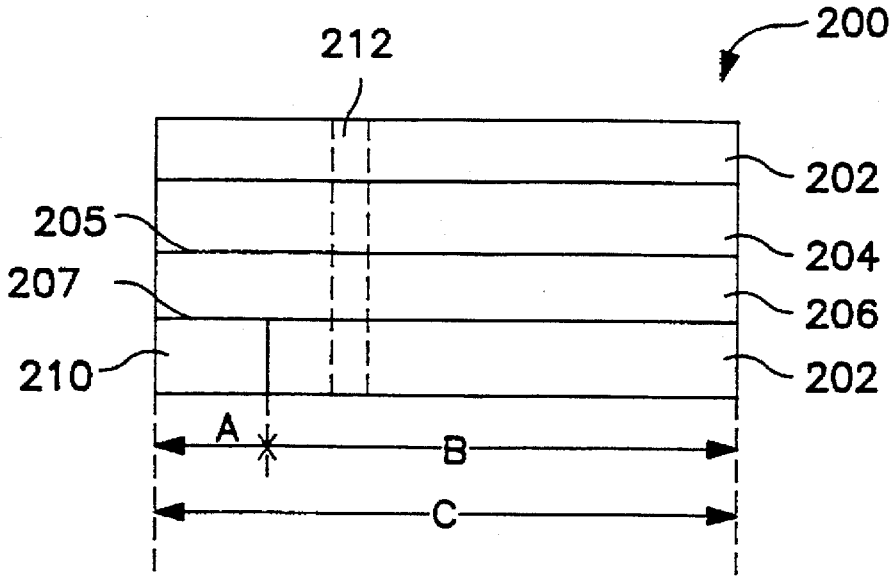
FIG. 2 is a cross sectional view of the tag according to the present invention.

Shown in FIG. 2 a cross section of tag 200. Tag 200 has a substantially tear-resistant (or reinforced) layer 206 having first and second surfaces 205 and 207. Tear-resistant layer 206 is made of a facestock material which has superior tensile and tear strength. As a result, it will not tear easily. A suitable facestock material is available from ICI Films of Wilmington, Del. under the registered trademark Melinex. A three-mil polyester film (Melinex® 339), which is an opaque white film with superb handling characteristics and a unique glossy appearance, has the following properties:

| General Properties | Test Method | Unit | Typical Values |
|---|---|---|---|
| Tensile Strength | ASTM D882A | PSI | MD 22,000<br>TD 23,000 |
| Yield Strength | ASTM D882A | PSI | MD 12,000<br>TD 12,000 |
| Elongation | ASTM D882A | % | MD 135<br>TD 90 |
| Density | ASTM D1505 | g/cc | 1.37 |
| Thermal | Unrestrained @ 190° C. for 5 min. | % | MD 1.5<br>TD 1.5 |

A printable or laser coating layer 204 is permanently adhered to first surface 205 of tear resistant layer 206. Laser coating layer 204 can be a matte top coating such as a commercially available water based or ultraviolet laser topcoating which accept imprinting from a variety of laser printers and copiers with excellent print resolution and toner anchorage. Laser coating layer 204 retains images in a non-transient manner for a significant period of time suitable for the desired use of the label. Thus, combination tag and label system 100 is adapted for use in conjunction with a laser printer and can travel through a laser printer or the like in one pass. This eliminates the need for multiple printers and multiple paper feeds.

Next, an ink 202 can be applied to the top of laser coating layer 204. Ink 202 and can be used for, but is not limited to, identifying the contents of a tanker, marking a grid sheet which discloses compliance with industry standards, a company logo, company tracking information, or various other indicia. An example of a series of inks suitable for ink 202 is the Werneke 4000 Series. Werneke 4000 Series inks are all-purpose, water-based inks primarily for use on non-porous synthetic stocks (films). The 4000 Series offers excellent adhesion and gloss. Ultra lightfast colors are used where maximum fade resistance is required, such as outdoor use, warning labels, or where Underwriters Laboratories' approval is desired. Ink 202 can also be placed on second surface 207 of tear-resistant layer 206.

First adhesive 210 is applied to second surface 207 of tear-resistant layer 206. First adhesive 210 may be pressure-sensitive. The adhesive which forms first adhesive 210 is a non-permanent, removable type of adhesive. First adhesive 210 should also be easily removable from release liner 300 to which tag 200 is attached before application to a tanker or the like.

Non-permanent adhesives include adhesives which, when used in the context of the present invention, allow tag 200 to be removed from a receiving surface without undue difficulty. Examples of such removable adhesives designed for use in laser printer applications are commercially available and are known by those skilled in the art. Of critical importance is the insubstantial area A of second surface 207 covered by first adhesive 210 for securing tag 200 to release liner 300 until removal of tag 200. Note that first adhesive 210 is applied to section A only and ink 202 (if applied, directly or indirectly, to the second surface 207 of tear-resistant layer 206) is applied to section B only of tag 200. (Of course, ink 202 may be applied anywhere in area C of tag 200) The length of section A may be 7 mm, for example, and the length of section B may be 108 mm (section C would have a length, therefore, of 115 mm). Preferably, the length of section A is less than ten percent of the length of section B.

Tag 200 is discrete and unperforated and can be removed from release liner 300 without the removal of discrete and unperforated label 400. Tag 200 has a hole 212 disposed through ink 202, laser coating layer 204, tear-resistant material 206, and the optional ink 202 which may be disposed on second surface 207 of tear-resistant material 206. Hole 212 is not disposed through first adhesive 210.

A feature of substantially non-adhesive tag 200 is that it is less likely than a tag having adhesive covering all or a substantial portion of its area to fold onto itself. As a result, tag 200 is more manageable. Another feature of the temporary adhesive nature of tag 200 is that unfolding of tag 200 is possible in the event that tag 200 folds onto itself. In addition, tag 200 is less likely to pick up as much dirt, debris, and the like as a tag that is substantially covered with adhesive. Tag 200 can be tied or attached, using hole 212, to another article with string 610 or the like (see FIG. 5).

C. Label

Figure 3:
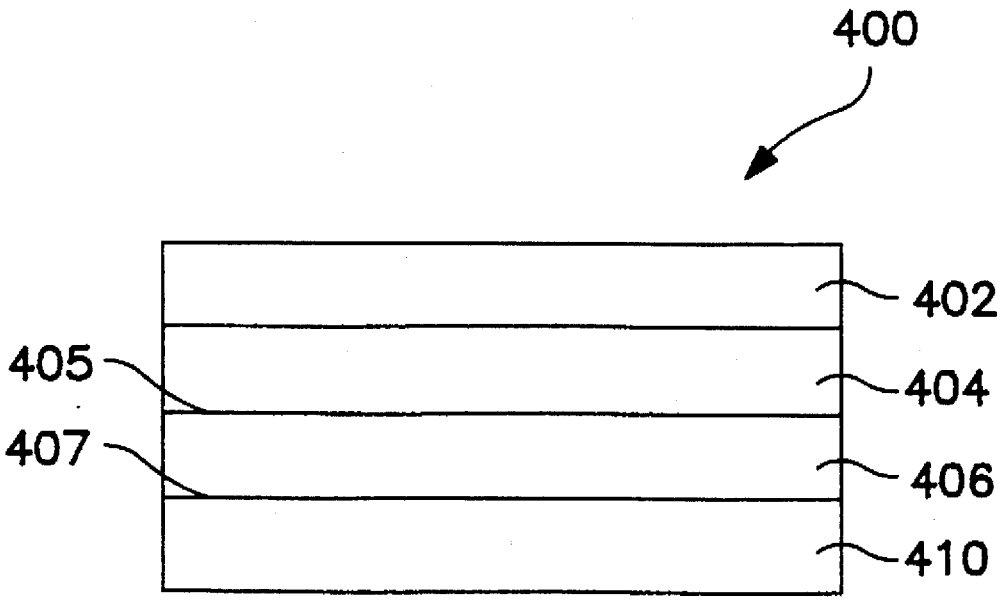
FIG. 3 is a cross sectional view of the label according to the present invention.

FIG. 3 is a cross section of label 400. Label 400 has a substantially tear-resistant layer 406 having first and second surfaces 405 and 407. Tear-resistant layer 406 may be made of the same facestock material used to form tear-resistant layer 206 of tag 200. That material is discussed above. A printable or laser coating layer 404 is permanently adhered to first surface 405 of tear-resistant layer 406. Laser coating layer 404 may be made of the same material used to form laser coating layer 204 of tag 200. That material is also discussed above. Next, ink 402 is applied to the top of laser coating layer 404. Ink 402 can be, but is not limited to, the same type as ink 202 discussed above.

Second adhesive 410 is applied to second surface 407 of tear-resistant layer 406. Substantially all of second surface 407 is covered with second adhesive 410. Second adhesive 410 is a permanent type for application to commonly used packaging substrates including polyethylene, polypropylene, cryovac, saran, and corrugated. Second adhesive 410 should be removable from release liner 300 to which label 400 is attached before application to a tanker or the like.

Second adhesive 410 can be a pressure-sensitive adhesive. Permanent adhesives include adhesives which, when used in the context of the present invention, allow label 400 to adhere to a receiving surface with such tenacity that removal without de-laminating the label is difficult. Such adhesives are also recognized in the art and include, for example, other type of commercially available permanent adhesives which are designed to withstand the heat of the fusing process associated with laser printers. Label 400 is substantially covered with second adhesive 410. Such complete coverage and the permanency of second adhesive 410 ensure that label 400 remains on the sample container 401 (FIG. 5) or an article to which label 400 is attached to provide a relatively permanent identification of the contents within the tanker sample container or other pertinent information. This is most useful in the chemical industry because chemicals are instantaneously identifiable with the label. Instantaneous identification permits a user to always handle the chemicals and the containers tankers or the like with the requisite care required by industry standards. In addition, permanent label 400, if marked properly with ink 402, helps identify necessary information for the particular chemical.

D. Alternative Embodiment of Combination Tag And Label System

Figure 4:
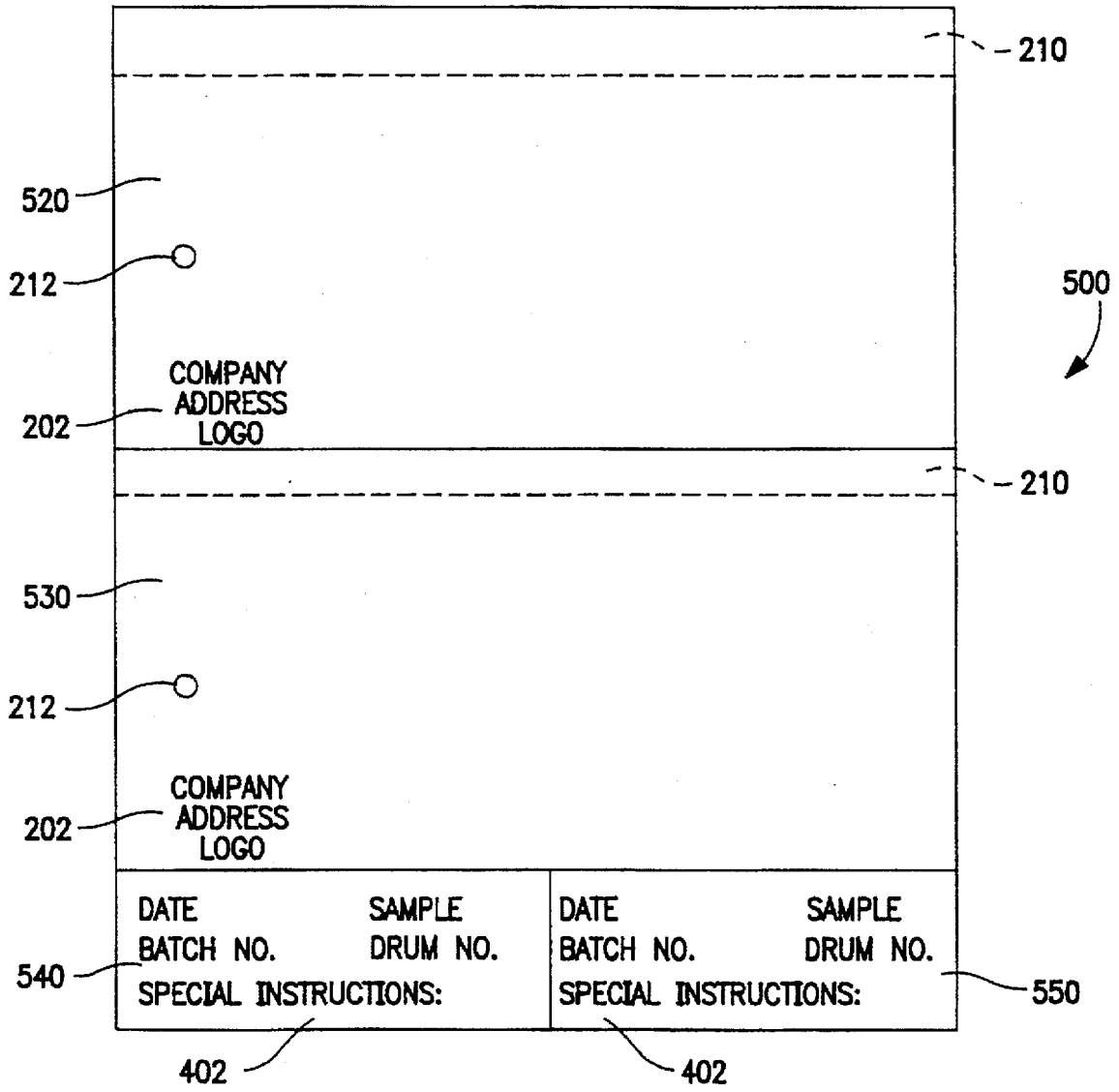
FIG. 4 is a top view of the combination tag and label system of a second embodiment according to the present invention.

There is shown in FIG. 4 another embodiment of a combination tag and label system 500 according to the present invention. Combination tag and label system 500 has a first tag 520, a second tag 530, a first label 540, and a second label 550. Combination tag and label system 500 shown in FIG. 4 can be comprised of the same layers described in FIG. 1; first and second tags 520 and 530 can be comprised of the same layers described in FIG. 2; and first and second labels 540 and 550 can be comprised of the same layers described in FIG. 3. Of course, tags 520 and 530 and labels 540 and 550 are removably connected to a release liner (not shown).

Tags 520 and 530 and labels 540 and 550 shown in FIG. 4 may differ from tag 200 and label 400 shown in FIGS. 1–3 by their dimensions. Combination tag and label system 500 shown in FIG. 4 may have tags 520 and 530 with completely different dimensions than labels 540 and 550. This feature may be result in smaller tags 520 and 530 and labels 540 and 550 and may be beneficial to prevent the unnecessary waste of materials used for making combination tag and label system 500.

E. Application of Combination Tag And Label System

Although one exemplary embodiment of the present invention comprises two detachable, essentially non-adhesive tags 520 and 530 and two adhesive labels 540 and 550, combination tag and label system 500 is still designed to be fed into a laser printer as a single sheet. A very thin strip of first adhesive 210 on the leading edge of tags 520 and 530 adheres tags 520 and 530 to release liner 300 while, at the same time, allowing for easy removal. Thus, tags 520 and 530 are essentially non-adhesive. Having first adhesive 210 on the leading edge, in the direction tags 520 and 530 are fed into the label printer, minimizes the amount of first adhesive 210 necessary to keep tags 520 and 530 on release liner 300, while allowing for a single sheet containing all labels and tags to be fed into a laser printer. Adhesive labels 540 and 550 can be imprinted with information and secured to the sample container 401 (FIG. 5), filled at the time a tanker is filled, where it would be beneficial to have a permanently adhered label. In this way, all information can be printed on a single pass through a single laser printer without the need for multiple printers and multiple paper feeds.

Figure 5:
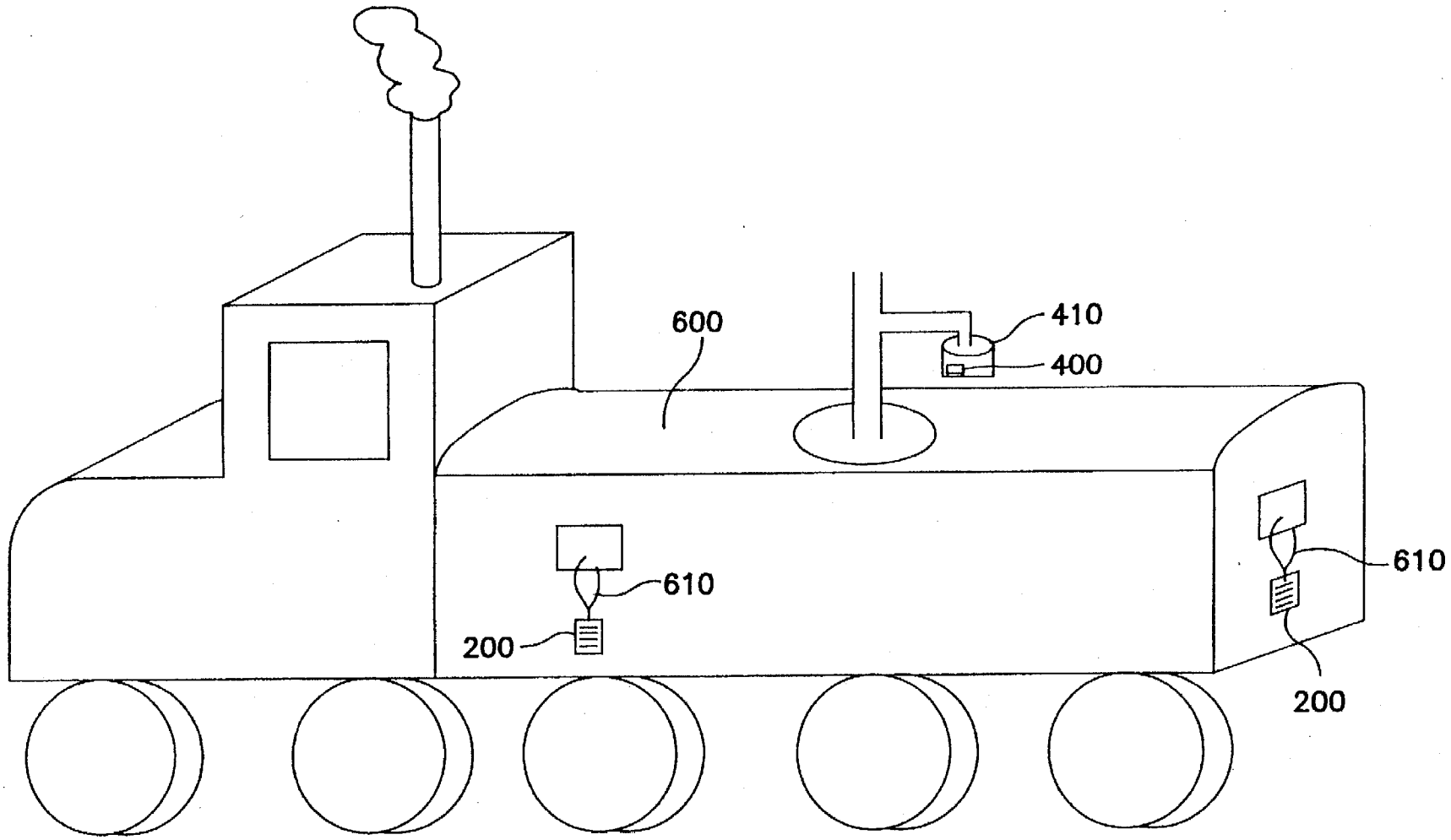
FIG. 5 is a side view of a tractor-trailer tanker with the combination tag and label system according to the present invention affixed.

Combination tag and label systems 100 and 500 are especially adapted for use in the chemical industry with bulk tankers such as the tractor-trailer tanker 600 shown in FIG. 5. Tags 200, 520, and 530 can be affixed to the bulk tanker through pre-punched hole 212 by a wire, string, or other fastener 610. Labels 400, 540, and 550 can be permanently affixed to the sample container 401 for quality assurance sampling using the relatively permanent second adhesive 410. Sample container 401 is typically filled at the time that tanker 600 is filled as illustrated in FIG. 5.

Although illustrated and described herein with reference to certain specific embodiments, the present invention is nevertheless not intended to be limited to the details shown. Rather, various modifications may be made in the details within the scope and range of equivalents of the claims and without departing from the spirit of the invention.

What is claimed is:

1. A multi-purpose, combination tag and label system adapted for use when shipping products in a tanker, said system comprising:

a release liner;

at least one unperforated tag having:

(a) a front surface,
(b) a back surface,
(c) a non-adhesive section, and
(d) an adhesive section disposed on said back surface bonding said at least one tag temporarily to said release liner, said adhesive section covering an insubstantial area of said at least one tag; and at least one unperforated label having:
(a) a front surface,
(b) a back surface, and
(c) an adhesive section disposed on said back surface bonding said at least one label temporarily to said release liner and substantially permanently to said tanker upon application to said tanker.

2. A system according to claim 1 wherein said adhesive section of said at least one tag comprises:
(a) a first ink,
(b) a printable layer,
(c) a tear-resistant layer, and
(d) a first adhesive;

said non-adhesive section of said at least one tag comprises:
(a) a first ink,
(b) a printable layer, and
(c) a tear-resistant layer; and said at least one label comprises:
(a) a first ink,
(b) a printable layer,
(c) a tear-resistant layer, and
(e) a second adhesive.

3. A system according to claim 2 wherein said adhesive section of said at least one label covers completely said back surface of said at least one label.

4. A system according to claim 2 wherein said tear-resistant layer of said at least one tag and said tear-resistant layer of said at least one label are each polyester film and said printable layer of said at least one tag and said printable layer of said at least one label are each a laser printable topcoating.

5. A system according to claim 2 wherein said first ink is a Werneke 4000 Series ink.

6. A system according to claim 2 wherein said first adhesive is removable and said second adhesive is permanent.

7. A system according to claim 1 wherein said adhesive section of said at least one tag covers less than ten percent of the length of said at least one tag.

8. A system according to claim 1 wherein said adhesive section of said at least one tag is about 7 mm long and said non-adhesive section of said at least one tag is about 108 mm long.

9. A system according to claim 2 further comprising a second ink disposed on said tear-resistant layer of said non-adhesive section of said at least one tag opposite said first ink.

10. A multi-purpose, combination tag and label system adapted for use when shipping products in a tanker, said system comprising:

a release liner;

at least one unperforated tag having:
(a) a front surface,
(b) a back surface,
(c) a hole disposed completely through said tag from said front surface to said back surface,
(d) printed matter deposited using an ink on at least one of said front surface and said back surface, and
(e) an adhesive section disposed on said back surface bonding said at least one tag temporarily to said release liner, said adhesive section covering an insubstantial area of said at least one tag; and at least one unperforated label having:
(a) a front surface,
(b) a back surface,
(c) printed matter deposited using an ink on said front surface, and
(d) an adhesive section disposed on said back surface bonding said at least one label temporarily to said release liner and substantially permanently to a sample container upon application to said sample container.

11. A system according to claim 10 wherein said adhesive section of said at least one tag comprises:
(a) a first ink,
(b) a printable layer,
(c) a tear-resistant layer, and
(d) a first adhesive;

said non-adhesive section of said at least one tag comprises:
(a) a first ink,
(b) a printable layer, and
(c) a tear-resistant layer; and said at least one label comprises:
(a) a first ink,
(b) a printable layer,
(c) a tear-resistant layer, and
(e) a second adhesive.

12. A system according to claim 10 wherein said adhesive section of said at least one label covers completely said back surface of said at least one label.

13. A system according to claim 11 wherein said tear-resistant layer of said at least one tag and said tear-resistant layer of said at least one label are each polyester film and said printable layer of said at least one tag and said printable layer of said at least one label are each laser printable topcoatings.

14. A system according to claim 11 wherein said first ink is a Werneke 4000 Series ink.

15. A system according to claim 11 wherein said first adhesive is removable and said second adhesive is permanent.

16. A system according to claim 10 wherein said adhesive section of said at least one tag covers less than ten percent of the length of said at least one tag.

17. A system according to claim 11 further comprising a second ink disposed on said tear-resistant layer of said non-adhesive section of said at least one tag opposite said first ink.

18. A multi-purpose, combination tag and label system adapted for use in shipping a product, said system comprising:

a tanker storing said product;

a release liner;

at least one unperforated tag having:
(a) a front surface,
(b) a back surface,
(c) a hole disposed completely through said tag from said front surface to said back surface,
(d) printed matter deposited using an ink on at least one of said front surface and said back surface,
(e) a non-adhesive section, and
(f) an adhesive section disposed on said back surface bonding said at least one tag temporarily to said release liner, said adhesive section covering an less than ten percent of the length of said at least one tag; and at least one unperforated label having:

(a) a front surface, (b) a back surface, (c) printed matter deposited using an ink on said front surface, and (d) an adhesive section disposed on said back surface bonding said at least one label temporarily to said release liner and substantially permanently to said product upon application to said product.

19. A system according to claim 18 wherein said adhesive section of said at least one tag comprises:

(a) a first ink, (b) a printable layer, (c) a tear-resistant layer, and (d) a first adhesive;

said non-adhesive section of said at least one tag comprises:

(a) a first ink, (b) a printable layer, and (c) a tear-resistant layer; and said at least one label comprises:

(a) a first ink, (b) a printable layer, (c) a tear-resistant layer, and (e) a second adhesive.

20. A system according to claim 18 wherein said adhesive section of said at least one tag is about 7 mm long and said non-adhesive section of said at least one tag is about 108 mm long.

* * * * *